US006476768B2

(12) United States Patent
Woo et al.

(10) Patent No.: US 6,476,768 B2
(45) Date of Patent: Nov. 5, 2002

(54) WIRELESS TRANSMITTING AND RECEIVING ANTENNA

(75) Inventors: Min-Jae Woo; Hyo-Jong Lee, both of Kyungki-do; Jae-Ho Lee, Incheon; Choong-Ki Cho; Kyoung-Jin Lee, both of Kyungki-do, all of (KR)

(73) Assignee: MRW Technologies Ltd., Seoul (KR)

( * ) Notice: Subject to any disclaimer, the term of this patent is extended or adjusted under 35 U.S.C. 154(b) by 0 days.

(21) Appl. No.: 09/750,979

(22) Filed: Dec. 28, 2000

(65) Prior Publication Data

US 2001/0028331 A1 Oct. 11, 2001

(30) Foreign Application Priority Data

Apr. 8, 2000 (KR) ..... 2000-18437
Nov. 16, 2000 (KR) ..... 2000-68222

(51) Int. Cl.[7] ..... H01Q 1/24
(52) U.S. Cl. ..... 343/702; 343/895; 343/725
(58) Field of Search ..... 343/702, 895, 343/725, 727, 729; H01Q 1/24

(56) References Cited

U.S. PATENT DOCUMENTS 6,111,554 A * 8/2000 Chufarovsky et al. ..... 343/895
6,191,755 B1 * 2/2001 Hamaaratsu ..... 343/895
6,222,506 B1 * 4/2001 So ..... 343/895
6,229,488 B1 * 5/2001 Lin et al. ..... 343/700 MS
6,262,693 B1 * 7/2001 Sutter et al. ..... 343/895
6,271,804 B1 * 8/2001 Yanagisawa et al. ..... 343/895

* cited by examiner

*Primary Examiner*—Hoanganh Le
(74) *Attorney, Agent, or Firm*—Alston & Bird LLP

(57) ABSTRACT

Disclosed is a wireless transmitting and receiving antenna which comprises a bobbin made of insulation material and having a first penetration cavity in the center of the bobbin in a lengthwise direction; a first antenna comprising a helical conductor spirally wound on the bobbin and having a resonance frequency, and a matching bar inserted into the cavity of the bobbin, made of a conductor and providing a second penetration cavity in the direction identical with that of the first penetration cavity; a feeder positioned at one part of the bobbin so as to supply signals to the helical conductor; and a second antenna comprising: a rod inserted into the penetration cavities of the bobbin and the matching bar, moving between the penetration cavities in a slipping manner, and wrapped with the insulation material; a conduction material combined to the outer part of the rod, and electrically connecting the feeder and the helical conductor when the rod is inserted into the penetration cavities; and a stopper which is made of a conductor, positioned at the lower part of the rod, and when the rod. is drawn Afro, the penetration cavity, the moving of the stopper is limited, and it is contacted to the feeder so as to supply signals to the rod.

3 Claims, 6 Drawing Sheets

WIRELESS TRANSMITTING AND RECEIVING ANTENNA

BACKGROUND OF THE INVENTION (a) Field of the Invention

The present invention relates to an antenna for transmitting and receiving radio frequencies. More specifically, the present invention relates to an antenna for transmitting and receiving radio frequencies so as to be used for a mobile communication terminal that operates in two frequency bands and to easily set resonance points.

(b) Description of the Related Art

Present mobile communication services share identical frequency bands by differing modulation methods or use different frequency bands like the case of cellular phones that operate at 824 to 894 MHz and personal communication services (PCS) that operate at 1.75 to 1.87 GHz.

Conventional antennas that use the above-noted frequency bands comprise helical antennas which are installed on an upper part, of portable wireless devices and on which a helical conductor is wound, and whip antennas which penetrate the helical antennas. In the case the whip antenna is withdrawn from the helical antenna, the whip conventional antenna is used after being connected to the helical antenna.

When the resonance points are needed to be set, a gap of the helical conductor of the helical antenna is varied or a diameter of the helical antenna is sequentially varied.

Since it is difficult to set the resonance points of the resonance frequency and it is not easy to assemble the helical conductor to which the resonance point is already set, precision degrees and productivity are decreased.

When withdrawing the whip antenna from the helical antenna and using the whip antenna, since the whip antenna is electrically connected to the helical antenna, the performance of the whip antenna becomes lower because of a coupling effect.

Also, conventional feeding is performed after a feeder and a part of the helical conductor are contacted, and since this configuration has a small contact area with the feeder, electrical signals may not be stably supplied because of contact problems. In particular, this configuration can be a problem in that a small outer shock generates a short state between the feeder and the helical conductor.

SUMMARY OF THE INVENTION

It is an object of the present invention to provide a wireless transmitting and receiving antenna for quickly and accurately setting the resonance point of the resonance frequency using a simple technical configuration so as to increase productivity, setting the resonance point of a wide resonance frequency band, and electrically separating the whip antenna and the helical antenna so as to not influence the helical antenna when the whip antenna is withdrawn from the helical antenna and used.

In one aspect of the present invention, a wireless transmitting and receiving antenna comprises a bobbin of insulation material; a helical conductor spirally wound on the bobbin; a matching bar inserted into a cavity of the bobbin, maintaining a predetermined gap with the helical conductor and setting a resonance point; and a feeder supplying signals to the helical conductor.

The matching bar is made of a conductor, is cylindrical, and has a cavity in the center of the matching bar in a lengthwise direction.

The bobbin is manufactured according to a molding process while the matching bar is inserted into the bobbin.

In another aspect of the present invention, a wireless transmitting and receiving antenna comprises a bobbin made of insulation material and having a first penetration cavity in the center of the bobbin in a lengthwise direction; a first antenna comprising a helical conductor spirally wound on the bobbin and having a resonance frequency, and a matching bar inserted into the cavity of the bobbin, made of a. conductor and. providing a, second penetration cavity. in the direction identical with that of the first penetration cavity, a feeder positioned at one part of the bobbin so as to supply signals to the helical conductor, and a second antenna comprising: a rod inserted into the penetration cavities of the bobbin and the matching bar, moving between the penetration cavities in a slipping manner, and wrapped with the insulation material; a conduction material combined with the outer part of the rod, and electrically connecting the feeder and the helical conductor when the rod is inserted into the penetration cavities; and a stopper which is made of a conductor, is positioned at the lower part of the rod so that when the rod is withdrawn from the penetration cavity the movement of the stopper is limited, and is contacted to the feeder so as to supply signals to the rod.

There is provided an insulation pad for disconnecting the electrical contact between the first and second antennas when the first antenna is drawn from the second antenna.

In a further aspect of the present invention, a wireless transmitting and receiving antenna comprises a bobbin made of insulation material and having a first penetration cavity in the center of the bobbin in the lengthwise direction; a first antenna comprising a helical conductor spirally wound on the bobbin and having a resonance frequency, and a matching bar inserted into the cavity of the bobbin, made of a conductor and providing a second penetration cavity in the direction identical with that of the first penetration cavity; a feeder insulated with the helical conductor, combined to an lower part of the bobbin, providing a third penetration cavity in the direction identical with that of the first penetration cavity, and contacting the matching bar so as to supply electrical signals, and a tension spring wherein a second antenna comprising a rod is inserted into the penetration cavities of the bobbin and the matching bar, moving in the penetration cavities in a slipping manner, being wrapped with the insulation material, comprising a cap and a conductive stopper for limiting the movements in the upward and downward directions, with the tension spring maintaining a predetermined position after the second antenna is moved and being made of a conductor.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Figure 1:
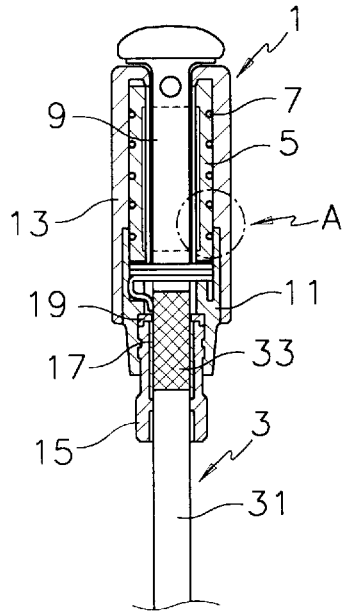
FIG. 1 shows an antenna according to a preferred embodiment of the present invention.

FIG. 1 shows an antenna for a wireless transmitter and receiver according to a preferred embodiment of the present invention. A whip antenna 3 is provided in a helical antenna 1.

The helical antenna 1 comprises a bobbin 5 which is fixed on an upper part of a portable wireless device (not illustrated), has a predetermined length, and has a cavity in the center part in the vertical direction, and a helical conductor 7 which is wound on the bobbin in a spiral manner.

Figure 2:
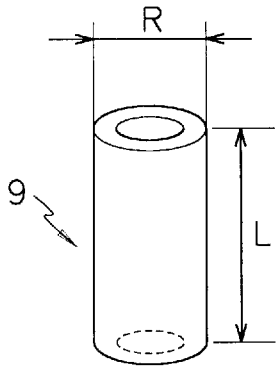
FIG. 2 shows a matching bar of FIG. 1.

The bobbin 5 is made of a nonconductor, and a matching bar 9 is combined and provided in the inner part of the bobbin 5. The matching bar 9, as shown in FIG. 2, has a cavity in the lengthwise direction, and is made of a conductor. When manufacturing the bobbin 5 by a molding process, the matching bar 9 is inserted in the bobbin 5 and they are manufactured as a single unit.

The matching bar 9 has a, diameter of R and a length of L, and these values are established according to values of the resonance point to be set in combination with the helical conductor 7. That is, a value for setting the resonance point of the resonance frequency is previously established, and the diameter and the length of the matching bar 9 are established according to the value. Since a capacitor value for adjusting the resonance point of the resonance frequency is determined according to the diameter and the length, the diameter and the length of the matching bar 9 are established according to the resonance point set by experimental values, and the matching bar 9 is combined with the bobbin 5 according to the above-described method. Outer lower parts of the helical conductor 7 and the bobbin 5 are combined with a first protection substance 11 made of a nonconductor, and a second protection substance 13 made of a nonconductor is combined with the first protection substance 11 and the bobbin 5 so as to wrap the first protection substance 11 and the bobbin 5. A feeder 15 for providing signals to the helical conductor 7 is provided on a lower part of the first protection substance 11. The feeder 15 has a cavity that penetrates it in the lengthwise direction. A cylindrical tension spring 17 made of a conductor is provided in the cavity of the feeder 15. A cylindrical insulation pad 19 is provided between the feeder 15, the tension spring 17 and the helical conductor 7.

A rod 31 of the whip antenna 3 can be inserted into or drawn from the cavity of the matching bar 9. The rod 31 comprises a cap for limiting the movement of the rod on an upper part of the rod 31, and a predetermined part of the rod 31 is wound with a conduction substance 33. It is preferable that when helical conductor 7 and the tension spring 17 connected to the feeder 15 the helical conductor 7 and the tension spring 17 connected to the feeder 15 are contacted so that the conduction substance 33 is positioned to transmit signals of the feeder 15 to the helical conductor 7. When the rod 31 is withdrawn from the helical antenna 7, a stopper 35 (shown in FIG. 4) made of a conductor that is provided to a lower part of the rod 31 in order for the lower part of the rod 31 to contact the feeder 15 transmits the signals of the feeder 15 only to the whip antenna 3, and concurrently prevents it from being completely separated from the helical antenna.

That is, when the whip antenna 3 is withdrawn from the helical antenna 1, the whip antenna 3 does not provide the signals of the feeder 15 to the helical conductor 7 because of the insulation pad 19, but instead provides the signals of the feeder 15 to the whip antenna 3 via the stopper 35 of the whip antenna 3.

Determination of a size and length of the matching bar 9 will now be described in detail.

Figure 3:
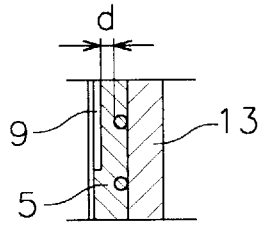
FIG. 3 shows a magnified A part of FIG. 1.

A target value for moving the resonance point of the resonance frequency is established. The resonance frequency relates to a capacitance value between the matching bar 9 and the helical conductor 7. The capacitance value is inversely proportional to the distance between the matching bar 9 and the helical conductor 7 (the distance is represented as distance 'd' in FIG. 3.), and is proportional to an area made by the matching bar 9 and the helical conductor 7. Hence, the matching bar 9 can adjust the resonance point by varying the diameter and the distance using experimental values. As mentioned above, the resonance frequency can be adjusted in a diversified manner according to frequency bands by varying the diameter and the length of the matching bar 9.

Figure 4:
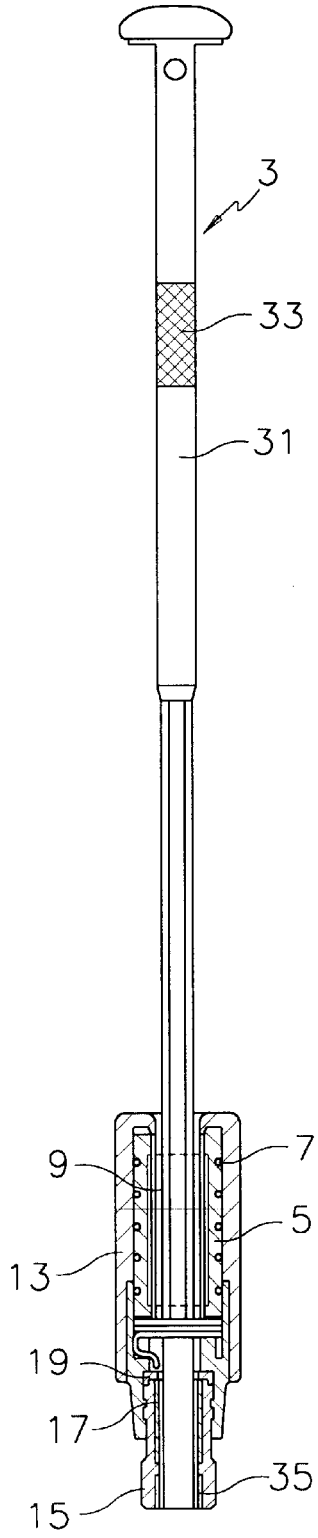
FIG. 4 shows a whip antenna outwardly extended.

Operation of the helical antenna 1 and the whip antenna 3 will be described hereinafter, and a process for transmitting signals to the helical antenna will be described now. The signals transmitted via the feeder 15 are provided to the helical conductor 7 passing through the tension spring 17 and then through the conduction substance 33 combined with the outer part of the rod 31. When the whip antenna 3 is withdrawn from the helical antenna 1, as shown in FIG. 4, the conduction substance 33 is moved, and the feeder 15 and the helical conductor 7 are electrically disconnected. The stopper 35 provided on the lower part of the rod 31 is closely attached to the lower part of the feeder 15 and therefore movement of the stopper 35 is limited, and concurrently signals are supplied to the whip antenna 3 from the feeder 15. Therefore, the helical antenna 1 is operated only while the whip antenna 3 is inserted, and the whip antenna 1 operates after it is withdrawn from the helical antenna 1. Therefore, the helical antenna 1 and the whip antenna 3 are individually operated to prevent the performance from being lowered by the coupling effect.

Figure 5:
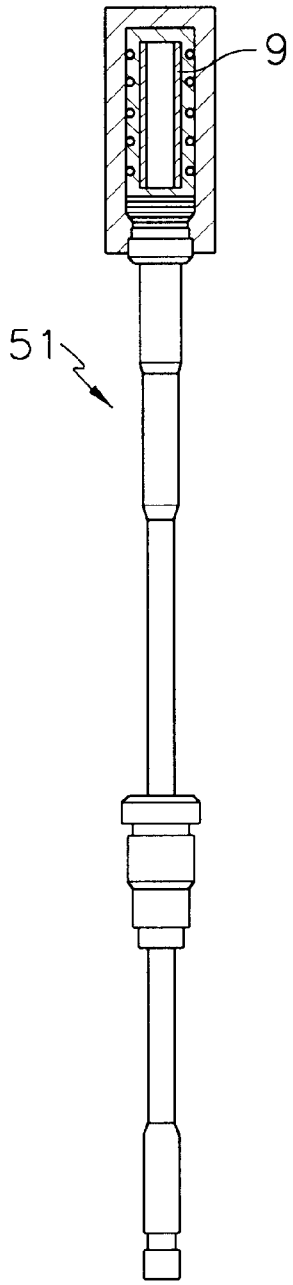
FIG. 5 shows a second preferred embodiment of the present invention.

FIG. 5 shows a second preferred embodiment of the present invention. FIG. 5 shows a cross sectional view of a top-loading antenna into which the matching bar 9 is inserted. In the top-loading antenna, the helical antenna is combined with the upper part of the whip antenna, and this second preferred embodiment can adjust the resonance point by using the matching bar 9.

A helical antenna is fixed ore a top part of the top loading antennae, and when the whip antenna is withdrawn, a fixing end is fixed to the feeder and the lower part of the whip antenna. When the whip antenna maintains a predetermined gap with the helical antenna formed on the top part, a coupling is formed, and frequencies vary according to length of the whip antenna by the degree of induced coupling, and in the frequency bands, impedance becomes wider as inductance and capacitance vary.

The helical antenna is operated when the whip antenna is inserted, and at this time, since there is a matching bar 9 provided in the helical antenna, the frequencies can be varied according to diameters, sizes and lengths of the matching bar 9, and the frequency bands become wider.

Figure 6:
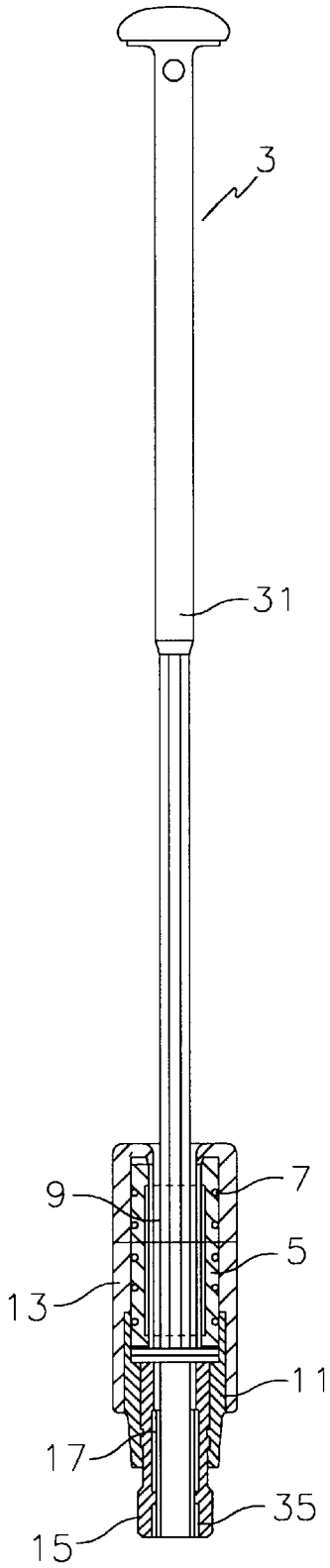
FIG. 6 shows a third preferred embodiment of the present invention.

FIG. 6 shows a cross sectional view of a bottom loading antenna cut in the lengthwise direction, and a matching bar 9 is inserted into the bottom-loading antenna.

When the whip antenna is withdrawn, a coupling is induced by the matching bar configured in the whip antenna and the helical antenna, the bottom loading antenna is operated, and the band width is determined by a matching value of the whip antenna and the helical antenna. When impedance components and capacitance components are varied according to the coupling degrees of the helical antenna, the bandwidth becomes wider and the length of the whip antenna becomes shorter. When the whip antenna is inserted, the helical antenna is operated, and the configuration and performance of the helical antenna is identical with those previously described.

Figure 7:
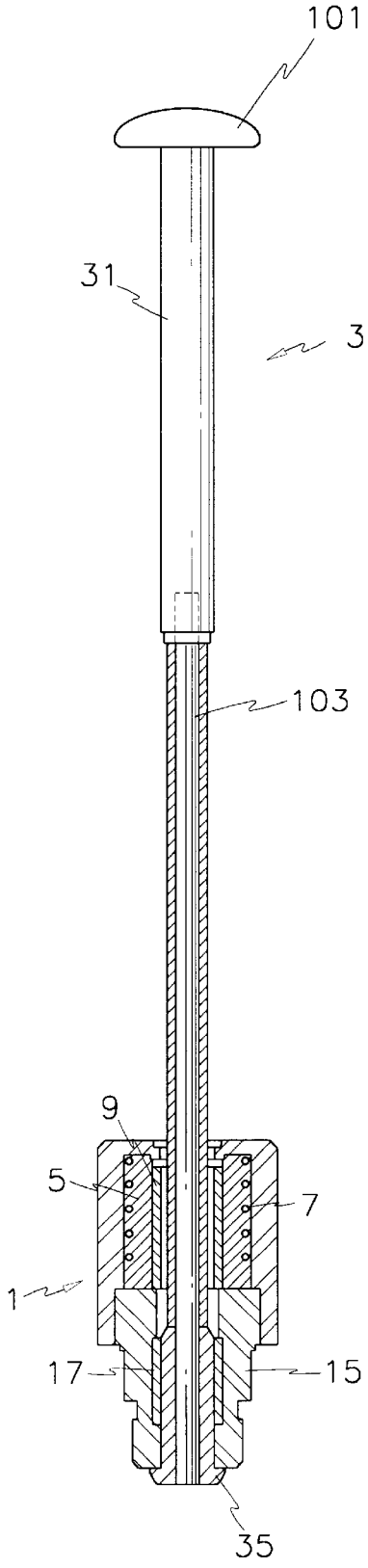
FIG. 7 shows a preferred embodiment of a feeder of the present invention.

FIG. 7 shows a preferred embodiment of a feeder of the present invention. A whip antenna 3 is withdrawn from the helical antenna 1 in the figure.

The helical antenna 1 comprises a bobbin 5 which is fixed on an upper part of a portable wireless device (not illustrated), has a predetermined length, and has a cavity in the center part in the vertical direction and a helical conductor 7 which is wound on the bobbin in a spiral manner. The helical conductor 7 and the feeder 15 are short.

The bobbin 5 is made of a nonconductor, and a matching bar 9 is combined and provided in the inner part of the matching bar 9. The matching bar 9 has a cavity in the lengthwise direction, and is made of a conductor. When manufacturing the bobbin 5 by a molding process, the matching bar 9 is inserted in the bobbin 5 and they are manufactured as a single unit.

The matching bar 9 has a diameter of R and a length of L, and these values are established according to values of the resonance point to be set in combination with the helical conductor 7. That is, a value of setting the resonance point of the resonance frequency is previously established, and the diameter and the length of the matching bar 9 are established according to the value. Since a capacitor value for adjusting the resonance point of the resonance frequency is determined according to the diameter and the length, the diameter and the length of the matching bar 9 are established according to the resonance point set by experimental values and. the matching bar 9 is combined with the bobbin 5 according to the above-described method. A feeder 15 is provide to the lower parts of the bobbin 5 and the matching bar 9 A cavity penetrates the inner part of the feeder 15 in the lengthwise direction.

The feeder 15 and the helical conductor 7 are separated, and the feeder 15 and the matching bar 9 are tightly combined in a surface-contacted state. That is, the upper part of the feeder 15 is tightly fixed to the lower part of the matching bar 9.

A cylindrical tension spring 17 is provided to the inner cavity of the feeder 15. The tension spring 17 made of a conductor has a predetermined elasticity so as to fix the whip antenna 3 at a predetermined position after the whip antenna 3 is moved in the upper or lower direction.

Figure 8:
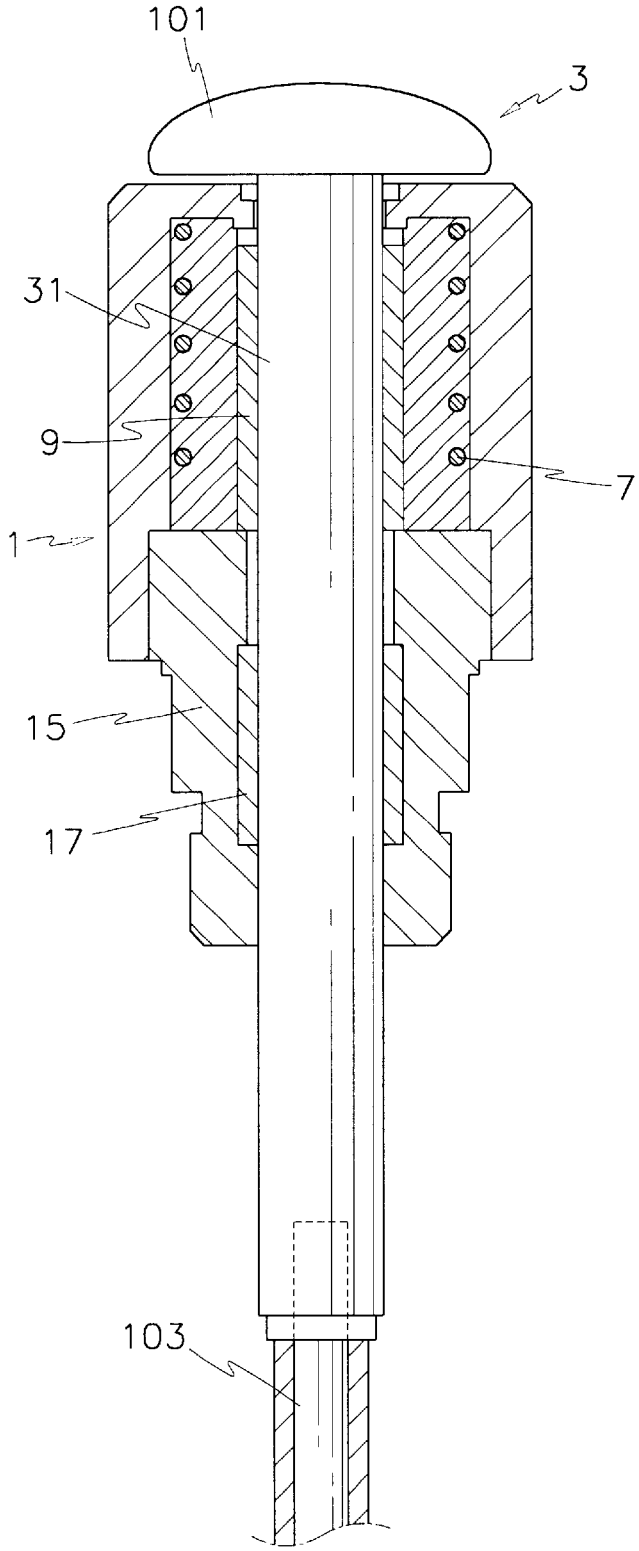
FIG. 8 shows a collapsed state of the whip antenna of FIG. 7.

The rod 31 of the whip antenna 3 is provided to the cavity of the matching bar 9 in order for the rod 31 to be inserted or withdrawn as shown in FIG. 8. The rod 31 comprises a cap 101 in the lower part of the rod 31 so as to restrict downward movement, and a stopper 35, made of a conductor, for limiting upward movement and transmitting electrical signals to a radiating element 103.

Determination of a size and length of the matching bar 9 will now be described in detail.

A target value for moving the resonance point of the resonance frequency is established. The resonance frequency relates to a capacitance value between the matching bar 9 and the helical conductor 7. The capacitance value is inversely proportional to the distance between the: matching bar 9 and the helical conductor 7, and is proportional to an area made by the matching bar 9 and the helical conductor 7. Hence, the matching bar 9 can adjust the resonance point by varying the diameter and the distance using experimental values. As mentioned above, the resonance frequency can be adjusted in a diversified manner according to frequency bands by varying the diameter and the length of the matching bar 9.

Operation of the helical antenna 1 and the whip antenna 3 will now be described. When the whip antenna 3 is inserted, the moving of the cap 101 positioned at the upper part of the rod 31 is limited by an antenna cover. The tension spring 17 maintains insertion by tightening of one part of the rod 31.

Regarding a signal transmission process to the helical antenna 1, the electrical signals are transmitted to the matching bar 9 tightly contacted to the feeder, via the feeder 15, and the matching bar 9 and the helical conductor 7 form a coupling. Therefore, the signals are transmitted. The frequencies can be varied by the configuration of the feeder, the sizes and the diameter of the matching bar 9, and the gap between the helical conductor 7 and the matching bar 9. Also, by adjusting the resonance point according to rotation number of the helical conductor 7, two resonance frequencies can be formed.

Regarding an operation of the whip antenna 3, when the whip antenna 3 is withdrawn, the moving of the stopper 35 positioned at the lower part of the rod 31 is restricted by the feeder 15. The tension spring 17 maintains withdrawn states by tightening of one part of the rod 31.

Regarding a signal transmission process to the, whip antenna 3, the electrical signals are transmitted to the matching bar 9 tightly contacted to the feeder, via the feeder 15, and the matching bar 9 and the helical conductor 7 form a coupling. At this time, the matching bands of the whip antenna 3 are varied by matching degrees of the helical antenna 1. The electrical signals transmitted via the feeder 15 are transmitted to the radiating element 103 of the whip antenna 3 through the tension spring 17 and the stopper 35. At this time, the length of the radiating element 103 can be reduced by the coupling operation of the helical conductor 7 and the matching bar 9. Also, regarding the length of the radiating element 103 of the whip antenna 3, since the capacitance components are varied according to the matching degrees of the helical conductor 7, matching bands become wider. Hence, two resonance points can be derived.

Therefore, two frequency resonance points can be set by the matching bar, and the electrical signals can be freely transmitted and durability can be improved by combining the one surface of the matching bar and the feeder.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A wireless transmitting and receiving antenna, comprising:

a bobbin made of insulation material and having a first penetration cavity in the center of the bobbin in a lengthwise direction, a first antenna comprising a helical conductor spirally wound on the bobbin and having a resonance frequency, and a matching bar inserted into the cavity of the bobbin, made of a conductor and providing a second penetration cavity in the direction identical with that of the first penetration cavity a feeder positioned at one part of the bobbin so as to supply signals to the helical conductor, and a second antenna comprising: a rod inserted into the penetration cavities of the bobbin and the matching bar, moving between the penetration cavities in a slipping manner, and wrapped with the insulation material; a conduction material combined to the outer part of the rod, and electrically connecting the feeder and the helical conductor when the rod is inserted into the penetration cavities; and a stopper which is made of a conductor, is positioned at the lower part of the rod, and when the rod is drawn from the penetration cavity, the movement of the stopper is limited, and is contacted to the feeder so as to supply signals to the rod.

2. The antenna of claim 1, wherein an insulation pad is provided for disconnecting the electrical contact between the first and second antennas when the first antenna is drawn from the second antenna.

3. A wireless transmitting and receiving antenna, comprising:

a bobbin made of insulation material and having a first penetration cavity in the center of the bobbin in a lengthwise direction;

a first antenna comprising a helical conductor spirally wound on the bobbin and having a resonance frequency, and a matching bar inserted into the cavity of the bobbin, made of a conductor and providing a second penetration cavity in the direction identical with that of the first penetration cavity;

a feeder insulated from the helical conductor, combined to an lower part of the bobbin, providing a third penetration cavity in the direction identical with that of the first penetration cavity, and contacting the matching bar so as to supply electrical signals; and a tension spring wherein a second antenna comprising a rod is inserted into the penetration cavities of the bobbin and the matching bar, moving in the penetration cavities in a slipping manner, being wrapped with the insulation material, comprising a cap and a conductive stopper for limiting the movements in the upward and downward directions, with the tension spring maintaining a predetermined position after the second antenna is moved and being made of a conductor.

* * * * *